US006947017B1

(12) United States Patent
Gettemy

(10) Patent No.: US 6,947,017 B1
(45) Date of Patent: Sep. 20, 2005

(54) DYNAMIC BRIGHTNESS RANGE FOR PORTABLE COMPUTER DISPLAYS BASED ON AMBIENT CONDITIONS

(75) Inventor: Shawn R. Gettemy, San Jose, CA (US)

(73) Assignee: Palm, Inc., Sunnyvale, CA (US)

( * ) Notice: Subject to any disclaimer, the term of this patent is extended or adjusted under 35 U.S.C. 154(b) by 151 days.

(21) Appl. No.: 09/942,437

(22) Filed: Aug. 29, 2001

(51) Int. Cl.[7] ..... G09G 3/28
(52) U.S. Cl. ..... 345/63; 345/690
(58) Field of Search ..... 345/63, 77, 204, 345/102, 207, 581, 589, 690; 348/602, 603

(56) References Cited

U.S. PATENT DOCUMENTS 5,760,760 A * 6/1998 Helms ..... 345/102
5,933,130 A * 8/1999 Wagner ..... 345/690
5,952,992 A * 9/1999 Helms ..... 345/102
6,094,185 A * 7/2000 Shirriff ..... 345/102

* cited by examiner

*Primary Examiner*—Chanh Nguyen
(74) *Attorney, Agent, or Firm*—Wagner, Murabito & Hao LLP

(57) ABSTRACT

A portable computer system that comprises dynamically adjustable brightness range settings and brightness control for providing improved user readability and prolonged component lifetime of the display screen. The main processor can change the range settings based on ambient light conditions or the user can perform the changes. The brightness level of the display changes according to a user selected setting within the range selected. The time required to implement the brightness change can be set to a value which can be configured by the user.

21 Claims, 8 Drawing Sheets

400

600

DYNAMIC BRIGHTNESS RANGE FOR PORTABLE COMPUTER DISPLAYS BASED ON AMBIENT CONDITIONS

BACKGROUND OF THE INVENTION

1. Field of the Invention

The present invention relates to the field of portable computer systems, such as personal digital assistants or palmtop computer systems. Specifically, embodiments of the present invention relate to a portable computer system equipped with a dynamic brightness range control to maximize readability in various ambient lighting conditions and to prolong the lifetime of the display, the light and the battery.

2. Related Art

A portable computer system, such as a personal digital assistant (PDA) or palmtop, is an electronic device that is small enough to be held in the hand of a user and is thus "palm-sized." By virtue of their size, portable computer systems are lightweight and so are exceptionally portable and convenient. These portable computer systems are generally contained in a housing constructed of conventional materials such as rigid plastics or metals.

Portable computer systems are generally powered using either rechargeable or disposable batteries. Because of the desire to reduce the size and weight of the portable computer system to the extent practical, smaller batteries are used. Thus, power conservation in portable computer systems is an important consideration in order to reduce the frequency at which the batteries either need to be recharged or replaced. Consequently, the portable computer system is placed into a low power mode (e.g., a sleep mode or deep sleep mode) when it is not actively performing a particular function or operation.

There are many other similar types of intelligent devices (having a processor and a memory, for example) that are sized in the range of laptops and palmtops, but have different capabilities and applications. Video game systems, cell phones, pagers and other such devices are examples of other types of portable or hand-held systems and devices in common use.

These systems, and others like them, have in common some type of screen for displaying images as part of a user interface. Many different kinds of screens can be used, such as liquid crystal displays, and field emission displays or other types of flat screen displays. Refer to FIGS. 1A–1D for examples of types of display screens.

As illustrated in FIG. 1A, a reflective display is shown including a display screen 110 having a reflective surface 130 so that the display is enhanced in bright external light 103 such as sunlight but requires a front light 120 in darker environments. The display screen 150 of FIG. 1B can also be transflective. It has a reflector 160 to reflect light from an external source 103. This reflector 160 comprises holes 170 through which light from the backlight 140 can pass for lighting darker environments. FIG. 1C illustrates another type of display screen which is transmissive. The transmissive display screen 101 has no reflector so it requires a backlight 102. When bright external light, such as sunlight, is present, this external light 103 competes with the backlight and it becomes difficult to see the transmissive display screen. Another non-reflective type of display is the emissive display screen as illustrated in FIG. 1D. Among the family of emissive display screens one finds Organic Light Emitting Diode (OLED), Organic Electro-Luminescent (OEL), Polymer Light Emitting Diode (Poly LED), and Field Emission Displays (FED). The emissive screen 190 contains light emitting elements and, therefore, requires no separate backlight. As with the transmissive screens, bright external light competes with the emitted light of the emissive display screen. Emissive and transmissive displays can not be viewed very well in the sun unless the brightness is turned very high. High brightness can reduce the life of the display and cause poor battery life performance.

One conventional approach to adjusting the brightness of the display with respect to the ambient light is to include photo detectors to adjust the brightness or to turn a backlight on or off. In this approach there is a fixed brightness range which does not always provide a comfortable viewing experience for the user.

Another conventional approach gives the user manual control of the amount of light being produced for the transmissive and emissive display screens. This approach is satisfactory for conscientious users who regularly monitor the brightness settings and manually adjust them accordingly. However, as is often the case, the user can set the display screen for maximum brightness so that the display is more easily read in sunlight, thereby not having to make frequent adjustments. In the case of the transmissive display, this frequently results in less than optimal battery and backlight lifetime experience. In the case of the emissive display, in addition to a reduced battery experience, the emissive material, usually either an organic or polymer, has a finite lifetime. This lifetime becomes severely shortened if the display screen is always turned to the maximum setting.

SUMMARY OF THE INVENTION

Accordingly, what is needed is a system and/or method that can provide a display which is readable in various ambient lighting conditions for a various types of display screens and which will provide the user with a pleasant battery experience and prolong the life of materials that would be harmed by excessive brightness. The present invention provides these advantages and others not specifically mentioned above but described in the sections to follow.

A portable computer system or electronic device which includes a lighted display device with dynamically adjustable range settings, a processor, a light sensor and a display controller is disclosed. In one embodiment, the processor implements the adjustment for the range settings based on prestored range configuration data and an ambient light information signal from the light sensor. In one embodiment of the present invention, the lighted display device is transmissive while in another embodiment the lighted display device is emissive.

In one embodiment of the present invention, the portable computer system or electronic device further includes a user adjustment for adjusting the light setting within the processor-implemented range setting for the display device. In another embodiment of the present invention, the user can change and control the configuration of the dynamically adjustable range settings. The dynamically adjustable range settings, in still another embodiment, can be overridden by the user, enabling the user to control the brightness of the display screen. In yet another embodiment, the relative position of the user-adjustable setting within a given range remains unchanged when the range setting changes.

In one embodiment of the present invention, the display controller implements an adjustment to the brightness of the display device according to the implemented range setting and user-adjustable setting within said range. In one embodiment this brightness adjustment is immediate while, in another embodiment, the brightness adjustment occurs over a longer time period, the time period being user-adjustable. In yet another embodiment, the time period for the brightness adjustment to occur is a fixed value.

Other features and advantages of the invention will become apparent from the following detailed description, taken in conjunction with the accompanying drawings, illustrating by way of example the principles of the invention.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

In the following detailed description of the present invention, numerous specific details are set forth in order to provide a thorough understanding of the present invention. However, it will be recognized by one skilled in the art that the present invention may be practiced without these specific details or with equivalents thereof. In other instances, well-known methods, procedures, components, and circuits have not been described in detail as not to unnecessarily obscure aspects of the present invention.

Notation and Nomenclature

Some portions of the detailed descriptions, which follow, (e.g., process 600 of FIG. 6) are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, as apparent from the following discussions, it is appreciated that throughout the present invention, discussions utilizing the following terms refer to the actions and processes of a computer system or similar electronic computing device. These devices manipulate and transform data that is represented as physical (electronic) quantities within the computer system's registers and memories or other such information storage, transmission or display devices. The aforementioned terms include, but are not limited to, "scanning" or "determining" or "generating" or "identifying" or "comparing" or "sorting" or "selecting" or "implementing" or "displaying" or "initiating" or the like.

Exemplary Palmtop Platform

The embodiments of the present invention may be practiced on any electronic device having a display screen, e.g., a pager, a cell phone, a remote control device, or a mobile computer system. The discussion that follows illustrates one exemplary embodiment being a hand held computer system.

Figure 1A:
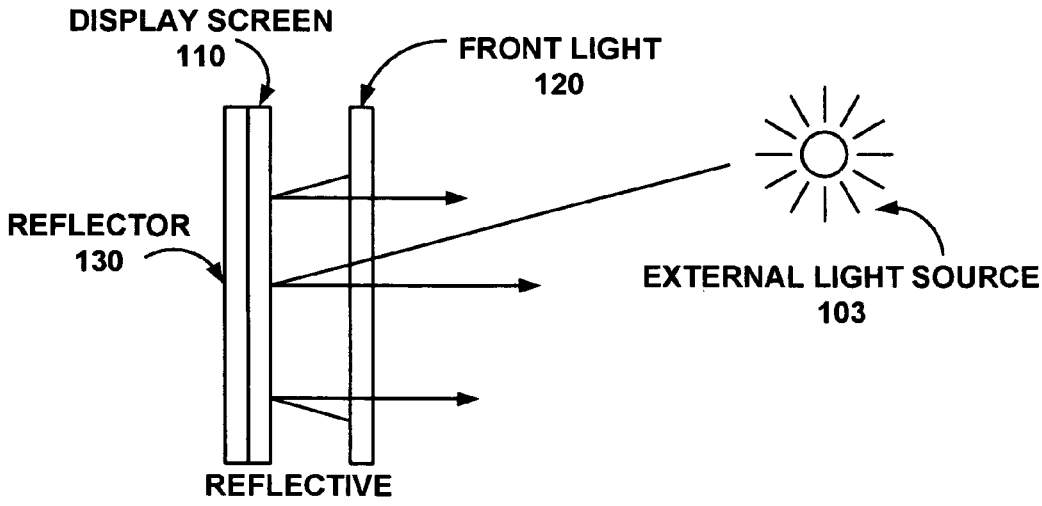
FIGURE 1A (PRIOR ART)
FIG. 1A illustrates a reflective display screen for use with a portable computer system or electronic device.
Figure 1B:
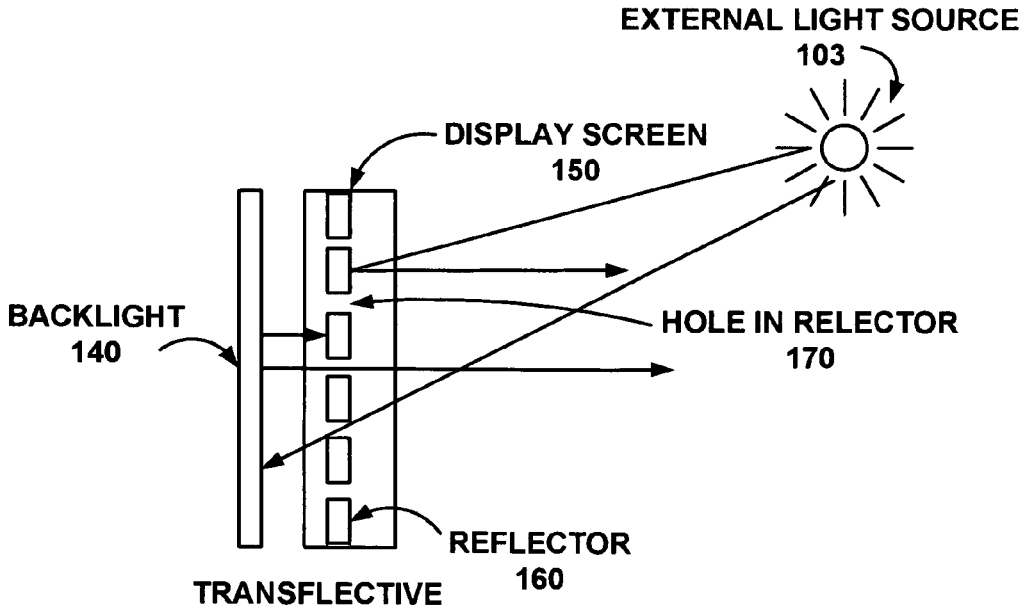
FIGURE 1B (PRIOR ART)
FIG. 1B illustrates a transflective display screen for use with a portable computer system or electronic device.
Figure 1C:
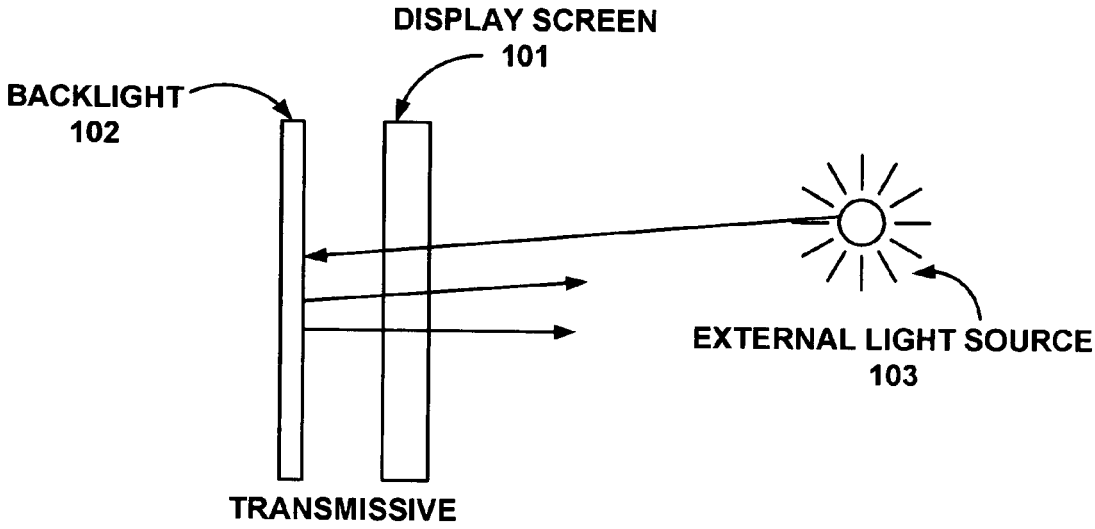
FIGURE 1C (PRIOR ART)
FIG. 1C illustrates a transmissive display screen for use with a portable computer system or electronic device.
Figure 1D:
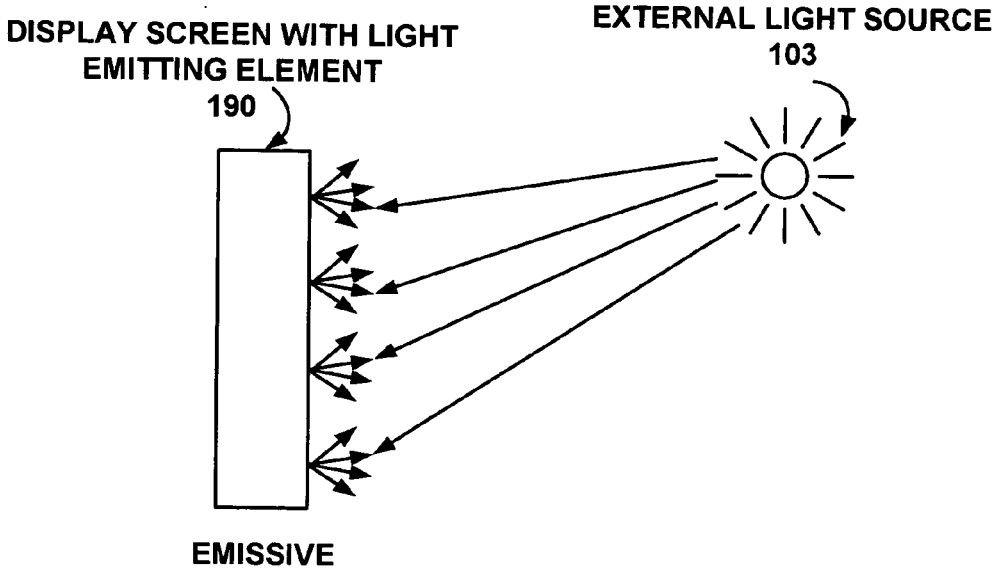
FIGURE 1D (PRIOR ART)
FIG. 1D illustrates an emissive display screen for use with a portable computer system or electronic device.
Figure 2A:
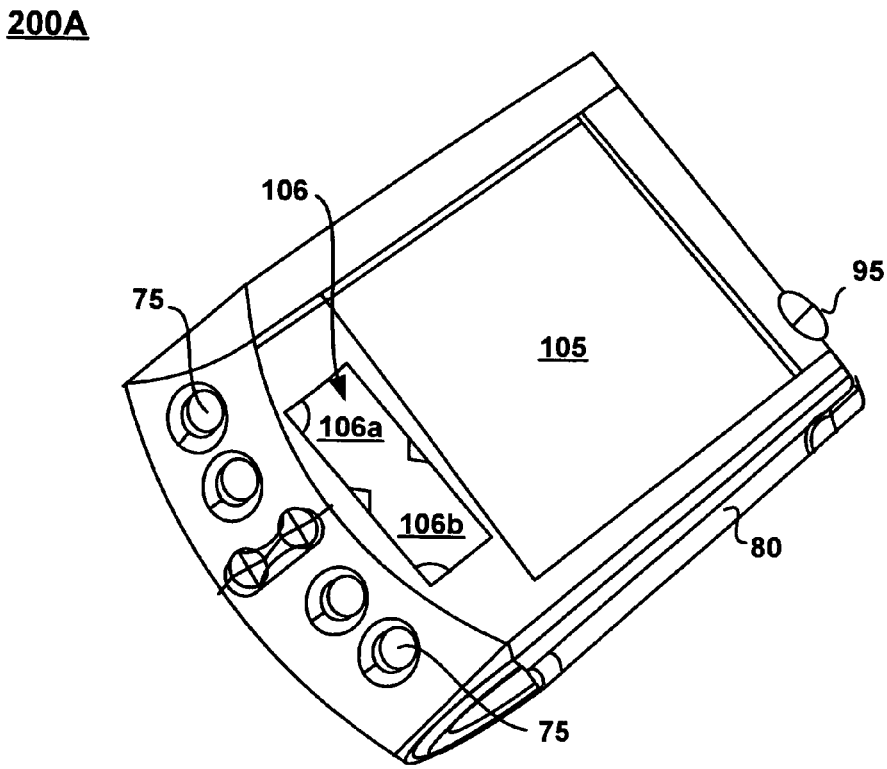
FIG. 2A is a topside perspective view of a portable computer system in accordance with one embodiment of the present invention.

FIG. 2A is a perspective illustration of the top face 200*a* of one embodiment of the portable computer system 300 of the present invention. The top face 200*a* contains a display screen 105 surrounded by has a top layer touch sensor able to register contact between the screen and the tip of the stylus 80. The stylus 80 can be of any material to make contact with the screen 105. The top face 200*a* also contains one or more dedicated and/or programmable buttons 75 for selecting information and causing the computer system to implement functions. The on/off button 95 is also shown.

FIG. 2A also illustrates a handwriting recognition area of the top layer touch sensor or "digitizer" containing two regions 106*a* and 106*b*. Region 106*a* is for the drawing of alphabetic characters therein (and not for numeric characters) for automatic recognition, and region 106*b* is for the drawing of numeric characters therein (and not for alphabetic characters) for automatic recognition. The stylus 80 is used for stroking a character within one of the regions 106*a* and 106*b*. The stroke information is then fed to an internal processor for automatic character recognition. Once characters are recognized, they are typically displayed on the screen 105 for verification and/or modification.

Figure 2B:
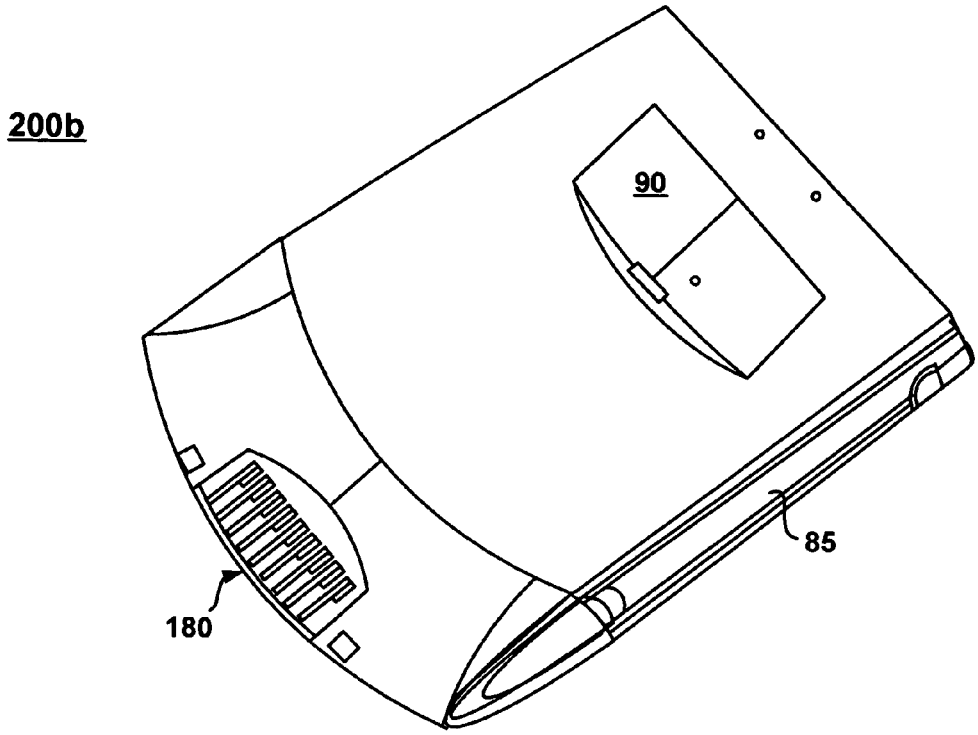
FIG. 2B is a bottom side perspective view of the portable computer system of FIG. 2A.

FIG. 2B illustrates the bottom side 200*b* of one embodiment of the palmtop computer system that can be used in accordance with various embodiments of the present invention. An extendible antenna 85 is shown, and also a battery storage compartment door 90 is shown. A serial port 180 is also shown.

Figure 3:
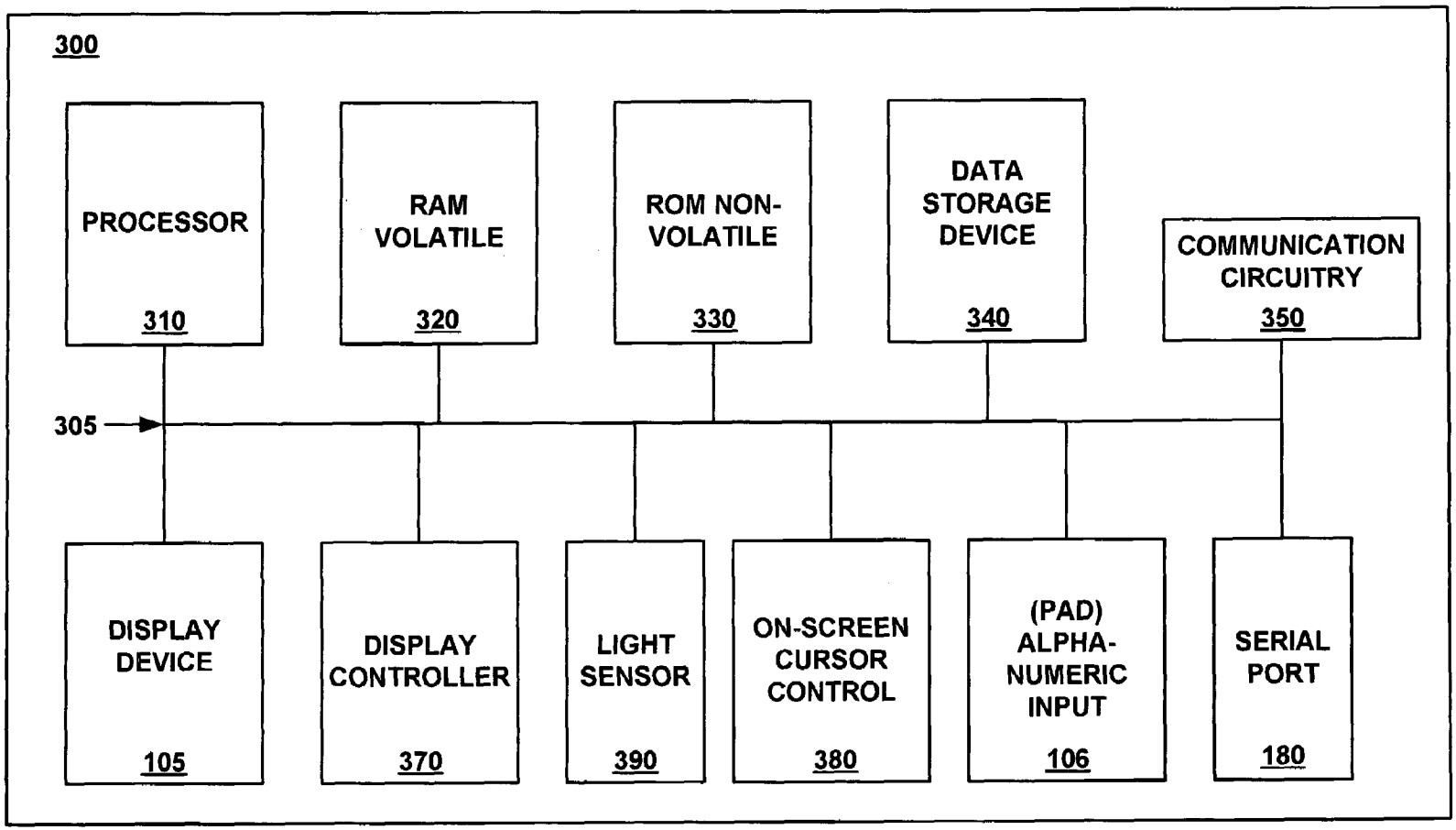
FIG. 3 is a block diagram of an exemplary portable computer system upon which embodiments of the present invention may be practiced.

FIG. 3 is a block diagram of one embodiment of a portable computer system 300 upon which embodiments of the present invention may be implemented. Portable computer system 300 is also often referred to as a PDA, a PID, a palmtop, or a hand-held computer system.

Portable computer system 300 includes an address/data bus 305 for communicating information, a central (main) processor 310 coupled with the bus 305 for processing information and instructions, a volatile memory 320 (e.g., random access memory, RAM) coupled with the bus 305 for storing information and instructions for the main processor 310, and a non-volatile memory 330 (e.g., read only memory, ROM) coupled with the bus 305 for storing static information and instructions for the main processor 310. Portable computer system 300 also includes an optional data storage device 340 coupled with the bus 305 for storing information and instructions. Device 340 can be removable. Portable computer system 300 also contains a display device 105 coupled to the bus 305 for displaying information to the computer user.

In the present embodiment, portable computer system 300 of FIG. 3 includes communication circuitry 350 coupled to bus 305. In one embodiment, communication circuitry 350 is a universal asynchronous receiver-transmitter (UART) module that provides the receiving and transmitting circuits required for serial communication for the serial port 180.

Also included in computer system 300 is an optional alphanumeric input device 106 that, in one implementation, is a handwriting recognition pad ("digitizer"). Alphanumeric input device 106 can communicate information and command selections to main processor 310 via bus 305. In one implementation, alphanumeric input device 106 is a touch screen device. Alphanumeric input device 460 is capable of registering a position where a stylus element (not shown) makes contact.

Portable computer system 300 also includes an optional cursor control or directing device (on-screen cursor control 380) coupled to bus 305 for communicating user input information and command selections to main processor 310. In one implementation, on-screen cursor control device 380 is a touch screen device incorporated with display device 105. On-screen cursor control device 380 is capable of registering a position on display device 105 where a stylus element makes contact. The display device 105 utilized with portable computer system 300 may utilize a reflective, transflective, transmissive or emissive type display.

In one embodiment, portable computer system 300 includes one or more light sensors 390 to detect the ambient light and provide a signal to the main processor 310 for determining when to implement a change in brightness range. Display controller 370 implements display control commands from the main processor 310 such as increasing or decreasing the brightness of the display device 105.

Figure 4:
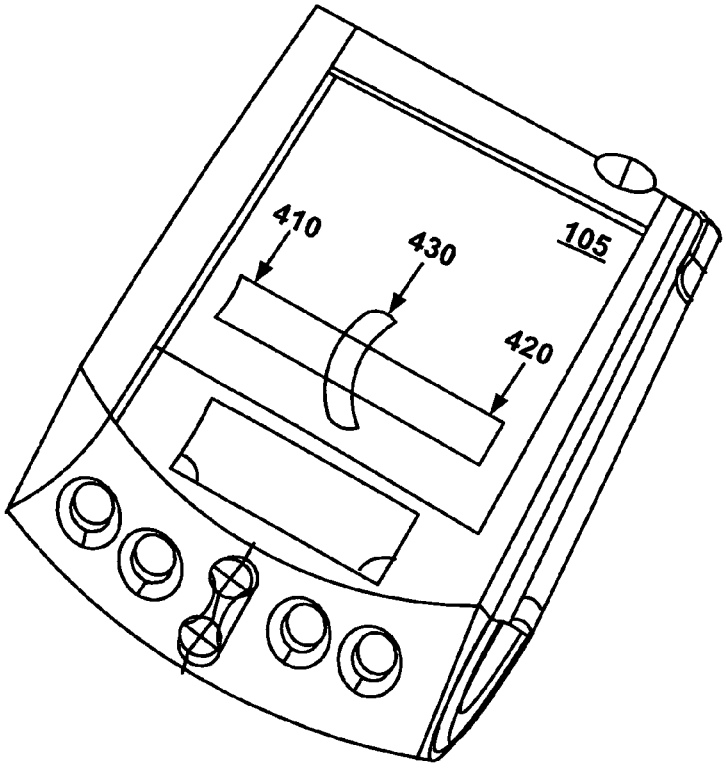
FIG. 4 is a perspective view of the display screen displaying the range and the user-controllable brightness adjustment according to one embodiment of the present invention.

Referring now to FIG. 4, a perspective view of one embodiment of the portable computer system 400 is shown. The display screen 105 is displaying the user brightness setting which may be implemented as a graphical user interface. In this embodiment the user adjusts the on-screen displayed brightness setting between the low level 410 of the range and the high level 420 of the range by moving the slider 430 to the right for an increase in brightness or to the left for a decrease in brightness.

Figure 5:
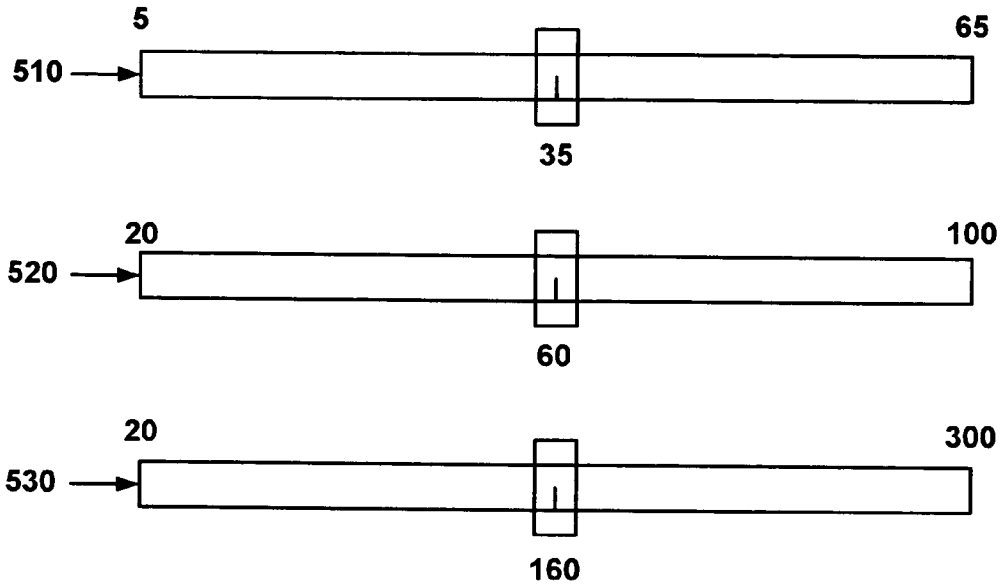
FIG. 5 illustrates one embodiment of the present invention, showing examples of computer generated and on-screen displayed dynamically adjustable range settings for various ambient light conditions, with corresponding dynamically changing brightness settings.

FIG. 5 illustrates three possible range settings and midpoint slide settings. The values are in candelas per square meter (cd/m$^2$), also called nits. These user interfaces are computer generated and displayed on the screen when the user desires to adjust the settings. Range 510 may be used when in a dark or dimly lit environment. Range 520 may be used in a normal office environment and range 530 may be used outdoors in direct sunlight. The units are measured in "nits".

Figure 6:
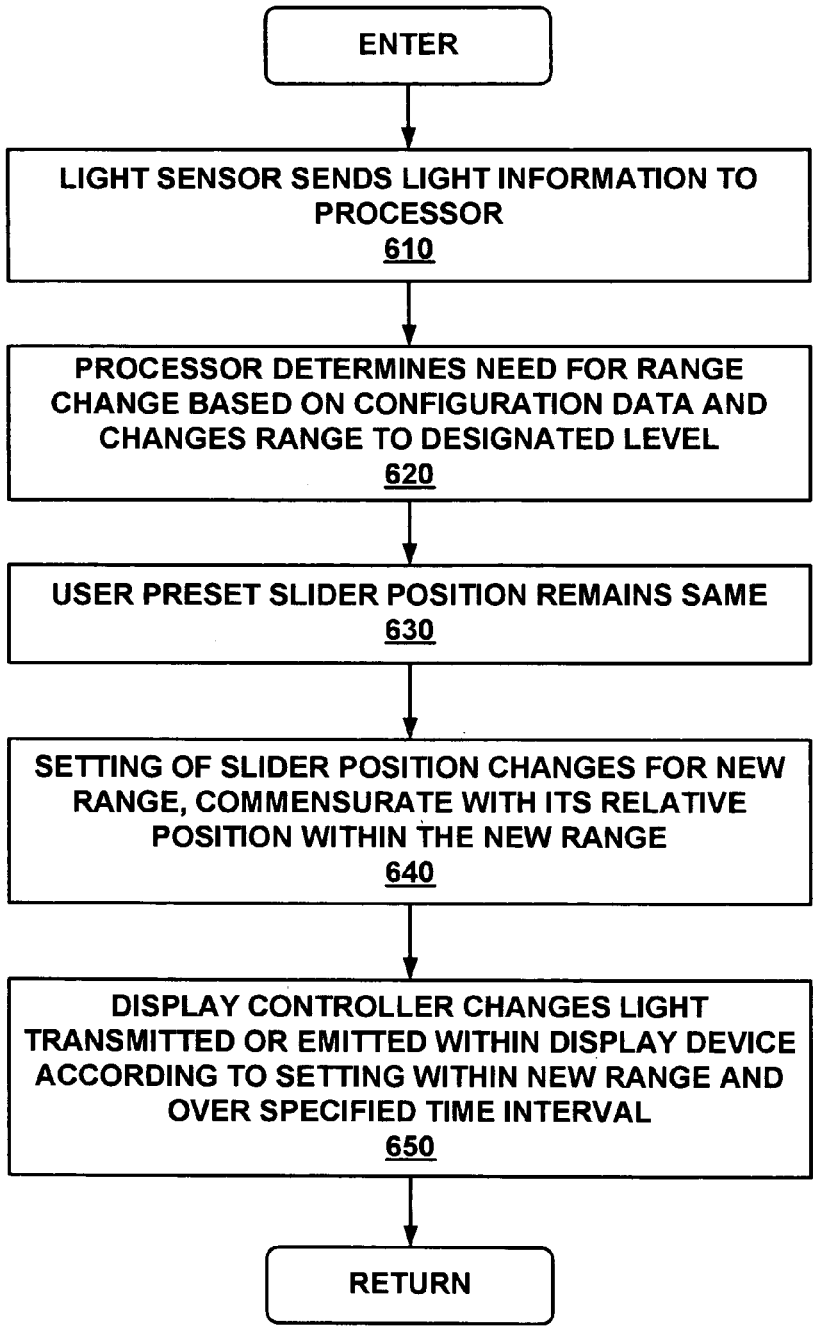
FIG. 6 is a block diagram illustrating the process of changing the range setting and the brightness of the display according to one embodiment of the present invention.

FIG. 6 is a block diagram illustrating one embodiment of the present invention. In step 610 one or more light sensors detect the ambient light and send a signal representing this information to the processor. The signal can be from a single sensor, or can be the average of signals from a plurality of sensors. The processor then, as shown in step 620, accesses stored data which configures the ranges and determines if the ambient light signal requires a change to the brightness range. If a change to brightness range is required, the processor then implements the range change.

In step 630 of FIG. 6, according to the present embodiment, the slider, which is on the user-adjustable range display of the display device, remains in the position to which the user last set it. Refer to FIG. 4 for an illustration of the slider 430, the low range setting 410, and the high range setting 420.

In step 640 of FIG. 6, the processor interprets the brightness setting of said slider position 430 relative to the low range setting 410 and the high range setting 420. For example, referring to 510 of FIG. 5, the midpoint setting for a brightness range of 5 nits to 65 nits is 35 nits, where the same midpoint setting for a brightness range of 20 nits to 300 nits, as shown on 530 of FIG. 5 is 160 nits.

Still referring to FIG. 6, the processor sends a signal to the display controller which, in step 650, implements the appropriate change to the brightness level over a time period specified by stored display configuration data so that brightness changes are not abrupt and therefore are transparent to the user.

Figure 7:
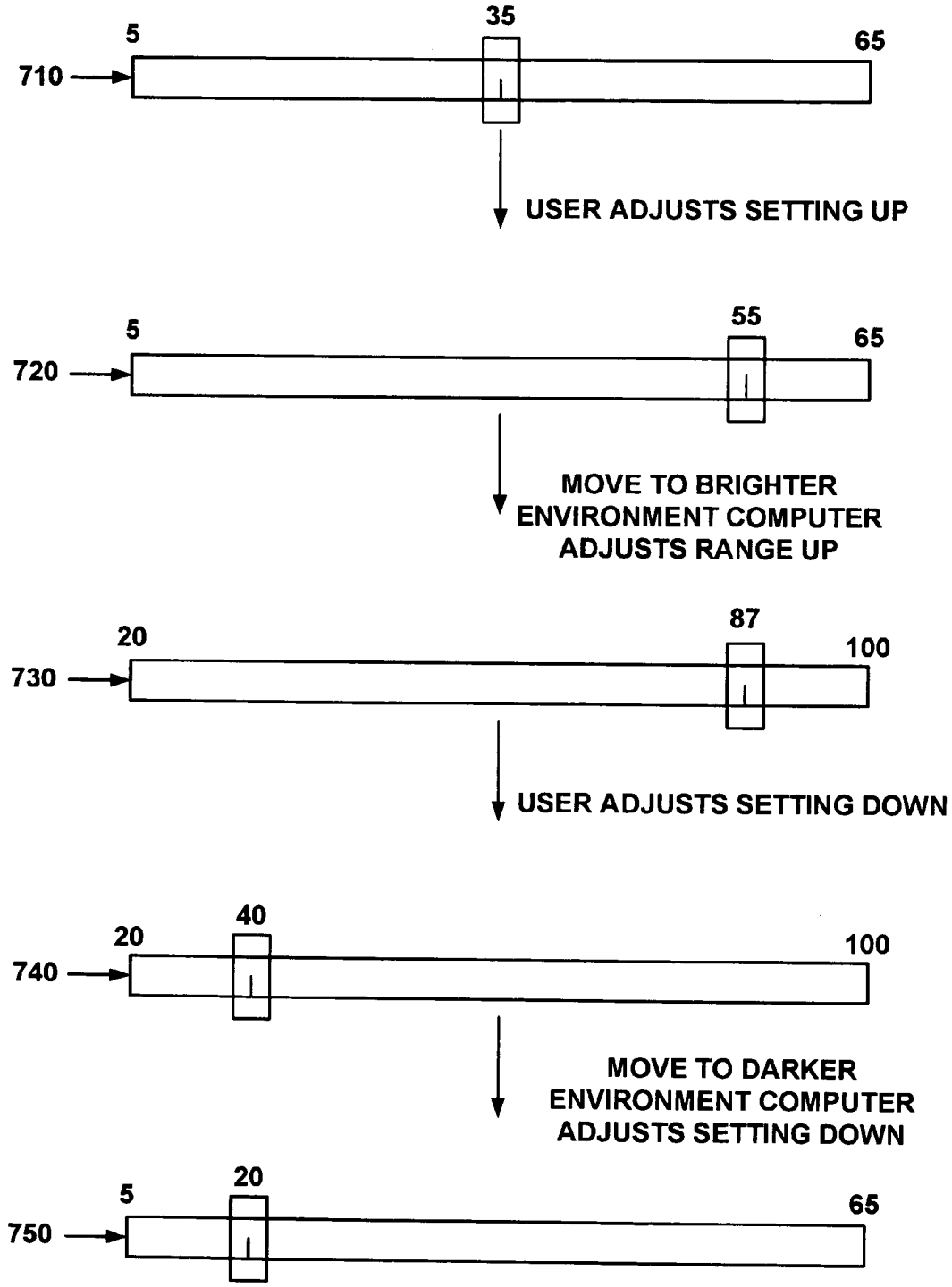
FIG. 7 illustrates changing of brightness settings by a user and changing of brightness ranges by a processor.

At any time, the user can display the currently selected range setting and move the slider up or down to increase or decrease the brightness setting of the display. The computer processor will dynamically adjust the range when the ambient light changes sufficiently, keeping the brightness level commensurate with the slider position last selected relative to the new range setting. FIG. 7 illustrates user adjustments to the brightness settings and computer processor adjustments to the brightness range.

In step 710 of FIG. 7, the brightness setting is at 35 nits on a range of 5 nits to 65 nits. The user adjusts the brightness setting up to a brightness of 55 nits, as shown in step 720. When the user goes into a brighter environment, the computer processor adjusts the range to that of 20 nits to 100 nits, as illustrated by step 730. The brightness setting for the previously set slider position is now 87 nits. The user now adjusts the setting down to a preferred level, e.g., 40 nits as shown in step 740. Now, when the user enters a darker environment, the computer processor adjusts the range down, as shown in step 750, so the setting for the previously set slider position is now 20 nits.

The present invention has been described in the context of a portable computer system; however, the present invention may also be implemented in other types of devices having, for example, a housing and a processor, such that the device performs certain functions on behalf of the processor. Furthermore, it is appreciated that these certain functions may include functions other than those associated with navigating, vibrating, sensing and generating audio output.

The preferred embodiment of the present invention, dynamic brightness range for portable computer displays based on ambient conditions, is thus described. While the present invention has been described in particular embodiments, it should be appreciated that the present invention should not be construed as limited by such embodiments, but rather construed according to the below claims.

What is claimed is:

1. A portable computer system comprising:

a processor coupled to a bus;

a light sensor coupled to said bus and for providing an ambient light information signal to said processor;

a lighted display device coupled to said bus and for providing a visual display;

a display controller coupled to said bus and for controlling said visual display;

a data storage device coupled to said bus and comprising preconfigured dynamically adjustable brightness range setting data for implementing a plurality of different simultaneously stored ranges, wherein each stored range of said plurality of stored ranges comprises a brightness range maximum value and a brightness range minimum value;

wherein said processor automatically selects a stored range of said plurality of stored ranges based on said ambient light information signal from said light sensor for use in dynamic brightness control;

an adjustment display coupled to said bus and comprising a brightness bar with user adjustable slider and a plurality of selectable brightness levels for enabling the user to adjust a brightness setting within said selected range for said display device; and wherein a position of said user adjustable slider remains unchanged in response to an automatic change in brightness range between a first selected range and a second selected range and wherein further, said position of said slider in said first selected range corresponds to a different brightness value compared to a brightness value corresponding to said same position of said slider in said second selected range.

2. The portable computer system of claim 1 wherein said lighted display device is transmissive.

3. The portable computer system of claim 1 wherein said lighted display device is emissive.

4. The portable computer system of claim 1 wherein said lighted display device is reflective.

5. The portable computer system of claim 1 wherein said lighted display device is transflective.

6. The portable computer system of claim 1 wherein said display controller adjusts brightness of said display device according to said range and brightness setting.

7. The portable computer system of claim 6 further comprising a time period for implementing any brightness changes to said display device.

8. The portable computer system of claim 7 wherein a setting for said time period is fixed.

9. The portable computer system of claim 7 wherein a setting for said time period is user-configurable.

10. A portable electronic device comprising:

a processor coupled to a bus;

a light sensor coupled to said bus and for providing ambient light information signal to said processor;

a lighted display device coupled to said bus and for providing a visual display;

a display controller and for controlling said visual display;

a data storage device coupled to said bus and comprising a plurality of simultaneously stored preconfigured dynamically adjustable brightness ranges, wherein each stored range of said plurality of stored ranges comprises a brightness range maximum value and a brightness range minimum value;

wherein said processor selects a brightness range of said stored brightness ranges based on preset range configuration data and said ambient light information signal from said light sensor for use in dynamic brightness control;

a graphical user interface coupled to said bus and comprising a brightness bar, a user adjustable slider, and a plurality of user selectable brightness levels, said graphical user interface for enabling the user to adjust brightness of said display device within said range setting; and wherein, the position of said user adjustable slider remains unchanged in response to an automatic change in brightness range between a first selected range and a second selected range and wherein further, said position of said slider in said first selected range corresponds to a different brightness value compared to a brightness value corresponding to said same position of said slider in said second selected range.

11. The portable electronic device of claim 10 wherein said lighted display device is transmissive.

12. The portable electronic device of claim 10 wherein said lighted display device is emissive.

13. The portable electronic device of claim 10 wherein said lighted display device is reflective.

14. The portable electronic device of claim 10 wherein said lighted display device is transflective.

15. The portable electronic device of claim 10 wherein said display controller implements adjustment to brightness of said display device according to said selected brightness range and brightness setting.

16. The portable electronic device of claim 15 further comprising a time-delay for implementing any adjustment to brightness of said display device.

17. The portable electronic device of claim 16 wherein said time delay is fixed.

18. The portable electronic device of claim 16 wherein said time delay is user-configurable.

19. In a portable electronic device, a method of responding to a change in ambient light conditions comprising:

a) detecting said change in ambient light conditions and generating a signal in response thereto;

b) in response to said signal, a processor of said portable electronic device selecting a brightness range from a plurality of simultaneously stored brightness ranges based on preconfigured range information for use in dynamic brightness control;

c) implementing said brightness range to alter the brightness of a display device of said portable electronic device, wherein each stored brightness range of said plurality of stored brightness ranges comprises a brightness range maximum value and a brightness range minimum value;

d) allowing a user to adjust a brightness setting within said selected brightness range using a user-adjustable slider, wherein a position of said user-adjustable slider remains unchanged in response to an automatic change in brightness range between a first selected range and a second selected range and wherein further, said position of said slider in said first selected range corresponds to a different brightness value compared to a brightness value corresponding to said same position of said slider in said second selected range; and e) altering said brightness of said display device based on said brightness setting.

20. A method as described in claim 19 wherein c) comprises employing a time delay between any brightness transition of said display device.

21. A method as described in claim 19 wherein a) is performed by a light sensor of said portable electronic device.

* * * * *